US010125436B2

(12) United States Patent
Barnes et al.

(10) Patent No.: US 10,125,436 B2
(45) Date of Patent: Nov. 13, 2018

(54) HIGH TENACITY LOW SHRINKAGE POLYAMIDE YARNS

(75) Inventors: John Alan Barnes, Dymock (GB); David Forbes Dempster, Inverary (CA)

(73) Assignee: INVISTA NORTH AMERICA S.A R.L., Wilmington, DE (US)

( * ) Notice: Subject to any disclaimer, the term of this patent is extended or adjusted under 35 U.S.C. 154(b) by 952 days.

(21) Appl. No.: 12/259,509

(22) Filed: Oct. 28, 2008

(65) Prior Publication Data

US 2009/0124149 A1 May 14, 2009

Related U.S. Application Data

(60) Provisional application No. 60/986,671, filed on Nov. 9, 2007.

(51) Int. Cl.

| | |
|---|---|
| ***D01D 5/16*** | (2006.01) |
| ***D01D 10/02*** | (2006.01) |
| ***D01F 6/60*** | (2006.01) |
| ***D02G 3/44*** | (2006.01) |
| ***D02J 1/22*** | (2006.01) |

(52) U.S. Cl.

CPC ..... *D01D 5/16* (2013.01); *D01D 10/02* (2013.01); *D01F 6/60* (2013.01); *D02G 3/446* (2013.01);

(Continued)

(58) Field of Classification Search

CPC . B60C 9/0042; B60C 9/00; D01F 6/60; D01F 6/62; D02J 1/22; Y10T 428/2913; Y10T 428/2929; Y10T 428/1362; Y10T 442/30; Y10T 442/3106; Y10T 428/1334; Y10T 428/1345; Y10T 428/2973;

(Continued)

(56) References Cited

U.S. PATENT DOCUMENTS 4,374,797 A * 2/1983 Koschinek et al. ..... 264/210.3
5,077,124 A * 12/1991 Clark et al. ..... 428/364

(Continued)

FOREIGN PATENT DOCUMENTS

EP 423806 A1 4/1991
EP 423808 A1 4/1991

(Continued)

OTHER PUBLICATIONS

Nexis Fibers, System & Conversion, http://www.nexisfibers.com/spip.php?rubrique76. Copyright 2010.*

(Continued)

*Primary Examiner* — Chinessa T. Golden
(74) *Attorney, Agent, or Firm* — Robert B. Furr, Jr.

(57) ABSTRACT

Multi-filament polyamide yarns characterized by high tenacity and low shrinkage are disclosed. Such yarns or fabrics made therefrom can be used in industrial applications in which such a combination of properties is desirable. Such yarns are particularly useful in the manufacture of automobile airbag fabrics. Also disclosed is a process for making such yarns. The yarn manufacturing process involves spin-drawing molten nylon, relaxing and controlling the yarn tension, and then winding the yarn. Yarns made according to this process exhibit linear density in the range of 110-940 decitex, tenacity equal to or greater than 80 cN/tex, and shrinkage, measured at 177° C., of less than 5%.

15 Claims, 2 Drawing Sheets

(52) U.S. Cl.
CPC ..... *D02J 1/22* (2013.01); *D10B 2331/02* (2013.01); *Y10T 428/298* (2015.01); *Y10T 428/2913* (2015.01); *Y10T 442/20* (2015.04); *Y10T 442/2139* (2015.04); *Y10T 442/30* (2015.04); *Y10T 442/3976* (2015.04)

(58) Field of Classification Search
CPC ..... Y10T 428/2975; Y10T 442/3065; Y10T 442/68; Y10T 428/2915; Y10T 428/298; Y10T 428/249922; Y10T 442/2139; Y10T 442/20; Y10T 442/3976; D01D 5/253; D01D 5/16; D01D 10/02; B60R 21/235; D03D 1/02; C09D 183/04; D06M 15/643; D06N 3/128; Y10S 8/01; C08L 83/00; C08L 2666/28; D02G 3/446; D10B 2331/02
USPC ..... 428/401, 364, 34.3, 34.5, 34.6, 34.7, 428/36.1, 225, 35.2, 35.5; 442/59, 76, 442/152, 158, 164, 168, 181, 301, 203, 442/218, 189, 400; 264/103, 210.8, 264/211.15, 211.17, 342, 210.7, 235.6, 264/290.5, 290.7, 177.13; 425/461; 528/15, 31, 32, 323, 324, 39; 57/243
See application file for complete search history.

(56) References Cited

U.S. PATENT DOCUMENTS

| | | | | |
|---|---|---|---|---|
| 5,240,667 | A * | 8/1993 | Andrews et al. | 264/210.7 |
| 5,302,432 | A * | 4/1994 | Shigeta et al. | 428/36.1 |
| 5,356,680 | A * | 10/1994 | Krummheuer et al. | 428/36.1 |
| 5,421,378 | A | 6/1995 | Bowers et al. | |
| 5,487,860 | A * | 1/1996 | Kent et al. | 264/103 |
| 5,554,424 | A * | 9/1996 | Krummheuer et al. | 428/35.2 |
| 5,558,826 | A * | 9/1996 | Jaegge et al. | 264/103 |
| 5,581,856 | A | 12/1996 | Krummheuer et al. | |
| 5,750,215 | A | 5/1998 | Jaegge et al. | |
| 5,922,366 | A * | 7/1999 | Short | 425/461 |
| 6,294,487 | B1 * | 9/2001 | Keshavaraj | 442/218 |
| 6,369,184 | B1 * | 4/2002 | Bohin et al. | 528/15 |

FOREIGN PATENT DOCUMENTS

| | | |
|---|---|---|
| EP | 442373 A1 | 8/1991 |
| EP | 1666647 A1 | 6/2006 |
| GB | 1105856 A | 3/1968 |
| JP | 62133108 A1 | 6/1987 |

OTHER PUBLICATIONS

Fourne', Franz, Synthetic Fibers, Machines and Equipment, Manufacture Properties, 1999, Hanser Publishers, Cincinnati.
Heat Shrinkage of Dacron Polyester and DuPont Nylon, Multifiber Bulletin X-199, Aug. 1965.
Hot Air Shrinkage Measurements on Nylon Yarns at Different Temperatures, PHP Laboratories.
Stibel, Werner, Fibers 3. General Production Technology, 2005, p. 26, Wiley-VCH Verlag GmbH & Co.I KGaA, Weinheim.

* cited by examiner

HIGH TENACITY LOW SHRINKAGE POLYAMIDE YARNS

CROSS-REFERENCE TO RELATED APPLICATION

This application claims benefit of priority from U.S. Provisional Application No. 60/986,671, filed Nov. 9, 2007. This application hereby incorporates by reference U.S. Provisional Application No. 60/986,671 in its entirety.

FIELD OF INVENTION

This invention relates to the preparation of high tenacity, low shrinkage polyamide, e.g., nylon, yarns. In particular, such a combination of physical properties is achievable by extruding molten nylon polymer in a coupled spin-draw process which includes a subsequent tension relaxation and control step prior to winding. Such yarns can be used in the manufacture of woven and knit fabrics, with such yarns and woven fabrics being especially useful for industrial applications such as automotive airbags.

BACKGROUND OF THE INVENTION

Polyamide yarns are frequently employed in industrial yarn and fabric applications requiring high strength. In order to develop maximum strength nylon yarns are manufactured by a spinning and drawing process that causes molecular alignment. The higher degree of orientation that is achieved, the greater is the tenacity and the lower is the available yarn elongation. A fundamental aspect of the production of fabrics using high tenacity yarns made with polyamides relates to the inherent shrinkage of the yarn. Due to the fact that the polymer undergoes a high degree of molecular alignment in the spinning and drawing process, such yarn has a natural tendency to contract. The rate and degree of contraction is a function of the degree of drawing (where more drawing leads to greater degree of contraction), the temperature to which the yarn is heated, and the time for which the yarn is held at temperature. Hence, it is normal to wash fabric in hot water and then dry in hot air in order to promote shrinkage and cause to fabric to become dimensionally stable. The degree of contraction of the fiber affects the efficiency of production of fabrics by virtue of a decrease in utilization of as-woven fabric as the fabric shrinkage encountered during post-weaving processing increases.

Known processes for making fully-drawn nylon yarns include the steps of extruding molten polymer through a spinneret to form filaments, quenching the molten filaments, coalescing the filaments to form a multifilament yarn and then drawing the yarn to increase molecular orientation, reduce available elongation and develop increased tenacity. Drawing is achieved by advancing the as-spun yarn from a feed roll to a draw roll, wherein the draw roll is rotating at a higher speed than the feed roll. The greater the extent of the drawing, the higher will be the yarn shrinkage. A process of this type, in which the spinning and drawing steps are integrated into a continuous manufacturing process, is referred to as a "spin-draw" process.

It is possible to produce very low shrinkage polyamide yarns using slow "two stage" processes, where the drawing is done in a separate step after the as-spun yarn has been wound and, therefore, the drawing and relaxing stages are decoupled from spinning. However, the product is found to be too crystalline prior to drawing to allow for very high draw levels without experiencing yarn breaks. Thus, the "two stage" process is not suitable for high production rate manufacture of very high tenacity yarns above about 80 cN/tex.

Highly drawn, high shrinkage yarns produced by the spin-draw process can cause subsequent processing problems due to the tension induced in the yarns by the drawing step. If not relieved, the tension may be high enough to cause the cardboard tube core on which the yarn package is wound to deform. Additionally, the low elongation resulting from the high degree of drawing can lead to an unacceptable number of yarn breaks. This problem increases in severity with the high threadline speeds that are necessary for economic high speed production.

In order to alleviate the problems of package deformation and threadline breakage, it is known to introduce a relaxation step following drawing in order to reduce the yarn tension, usually while heating, prior to wind-up. One such process has been disclosed in U.S. Pat. No. 5,750,215 to Jaegge et al., the teachings of which are incorporated by reference. U.S. Pat. No. 5,750,215 employs a relaxation step in order to produce yarn package comprising nylon 6,6 yarn, such yarn characterized by an elongation of about 22% to about 60%, a boil-off shrinkage of about 3% to about 10%, a tenacity of about 3 to about 7 grams per denier (32.7-76.5 cN/tex) and a yarn tube compression insufficient to crush the tube core on which the yarn package is wound.

A limitation that is observed in the nylon yarn manufacturing process described by U.S. Pat. No. 5,750,215 are operating constraints which affect the extent to which the tension can be reduced between the draw zone and the relaxation zone. If the tension is reduced to too low of a level, the yarn becomes completely unstable leading to filamentation (or splaying of the individual filaments) and threadline breaks. The point at which this tension let-down becomes great enough to induce threadline instability is a relaxation ratio, according to Formula 1, greater than about 9%.

$$\text{Relaxation Ratio (\%)}=((R_D-R_R)/R_D)\times 100, \text{ where} \quad [1]$$

$R_D$ is the peripheral speed of the final stage draw rolls, and $R_R$ is the peripheral speed of the relaxation rolls For many high strength fabric applications, the high shrinkages inherent to the high strength yarns used for such applications translate into high fabric shrinkages. For airbag applications, fabrics are required to exhibit both high strength, with a particular emphasis on the ability of the fabric to resist tearing and bursting when deployed, and low air permeability. Yarns that are suitable for airbag fabrics typically exhibit tenacities in the range of 60-85 cN/tex and hot air shrinkages (at 177° C. measured according to ASTM D 4974) of 5-15%. Low permeability can be achieved by applying a low permeability coating to at least one side of the fabric, or by producing a fabric with a very tight weave, or by some combination of those two measures. High strength is an essential characteristic of a fabric intended for this use since an airbag must be able to withstand the initial shock of an explosive inflation and, immediately thereafter, the impact of a passenger thrown against it. It must withstand these forces without bursting, tearing or appreciable stretching.

In most cases fabrics must be scoured to remove finish oils applied during yarn spinning and lubricants or bonding coatings applied prior to the weaving process. Thus, the woven fabrics are typically subjected to a washing step, followed by heating in dry air. The high shrinkage exhibited by the fabric in response to the washing and drying steps are used to advantage in order achieve a tighter weave and correspondingly lower air permeability. U.S. Pat. No. 5,581,856 teaches the manufacture of a fabric comprised of polyamide yarns having a hot air shrinkage at 160° C. of 6-15% (according to ASTM D4974). The as-woven fabric is subsequently subjected to treatment in an aqueous bath in a temperature range from 60° to 140° C. These conditions result in shrinkage leading to a further increase in density of the fabric which was already densely woven. The advantageous result is substantial closure of the pores of the fabric and a consequent improved resistance to gas permeability. In alternate processing for fabrics which require additional coating for either thermal protection or essentially zero air permeability, it is normal for the fabric to be "heat set" after washing. In this process the washed fabric is dried at temperatures close to or above those that will be experienced in coating and are typically in the region of 170° C.-225° C. Minimizing the degree of inherent shrinkage in the yarn allows drying at temperatures towards the lower end of this range and minimizes the risk of thermal damage to the yarn, an effect which usually manifests itself in the form of fabric discoloration.

"Air permeability" refers to the rate of air flow through a material and can be further defined as either "static air permeability" at a constant differential pressure across the fabric, or "dynamic air permeability" measured subsequent to a volume of air being introduced into a confined space over the fabric so as to generate an initial differential pressure. For the purpose of discussion throughout this application, air permeability will be of the static type which is defined as the volume rate of air at a differential pressure of 500 Pa through an area of 100 $cm^2$ and expressed in $l/dm^2/min$. This performance parameter is measured according to ISO 9237.

Fabrics intended for use in vehicle airbags have been woven by a variety of conventional weaving methods, including rapier, projectile, air-jet and water-jet weaving. Historically, many such fabrics have been formed using conventional rapier weaving machines wherein the weft yarn is drawn mechanically across the warp. Such weaving practices have been successful in producing the high weave density which is required for fabric that must exhibit low air permeability and which demonstrates the structural stability to withstand the inflation and collision forces when the airbag is deployed during an accident. However, rapier weaving machines can be significantly slower than alternative technologies such as water-jet weaving and can also inflict damage to the yarns during weaving due to frictional forces between the yarn and the weaving machine parts, as well as between the warp and weft yarns.

In water-jet weaving, the weft yarn is drawn through the shed of the warp yarns by means of a stream of water. This weaving method represents a much faster method of weft yarn insertion. Water-jet weaving can eliminate the need both for application of sizing compounds to the yarn and a separate washing or scouring operation. However, waterjet weaving historically has provided lower density weave constructions then rapier machines. In order to compensate, yarns having high breaking tenacities are often used so as to provide improved strength in the final fabric despite the less dense weave construction attainable by water-jet weaving. U.S. Pat. No. 5,421,378, incorporated herein by reference, has disclosed a method for manufacturing airbag fabrics by water-jet weaving of unsized yarns that is able to achieve weave densities comparable to rapier weaving.

While high fabric shrinkage may be used to advantage in order to achieve higher weave densities and low air permeabilities, it can also lead to manufacturing inefficiencies. In the production of one piece woven side-curtain airbag fabric, for example, the manufacturer has a desire to maximize the number of airbags that can be cut from one piece of fabric. The higher the shrinkage, the more constrained the manufacturer is in the number of pieces that can be cut from an as-woven fabric blank of a given width.

Side-curtain airbags are generally rectangular in shape and can, therefore, be made in contiguous rows across the width of the loom. Both sides of the inflatable structure may be cut as a one piece unit, which is subsequently folded in half to form an inflatable airbag. Alternatively, as in the case of jacquard looms, each such airbag can be made in one integral piece. The width of the fabric is limited first by the available width of weaving looms and second by the manageable complexity of jacquard heads. It is uncommon to find devices capable of weaving fabric more than 2.9 m wide. The fabric must then be shrunk to dimensionally stabilize it and, in the heretofore state-of-the-art case, shrinkages of the order of 8% are common. Hence, the airbag manufacturer is constrained in the minimum waste case to make an integral number of side curtain airbags across a width of (2.9-8%) m or 2.67 m. Thus, 3 airbags each of 0.89 m wide are optimal, or 4 each of 0.668 m or 5 each of 0.534 m or 6 each of 0.445 m and so forth.

Side-curtain airbags are required to fill the gap between the roof line of an automobile and the bottom of the window in the door, and this distance is rarely less than 0.4 m or more than 0.6 m. It is preferred that the shrinkage of the fabric in the weft direction is minimized to allow the maximum number of airbags to be manufactured.

Side-curtain airbags are engineered to remain inflated for a relatively longer period of time to protect a passenger against multiple and repetitive impacts within the automobile for the duration of an event in which the vehicles rolls over multiple times. Unlike front end collisions, in which the front end automobile occupant benefits both from the large energy-absorbing crumple zone and the front airbag, in side collisions there is no significant protection secondary to the side curtains and side airbags. As a consequence, side-curtain airbags are designed to operate with high internal pressures to maintain separation between the occupant and penetrating hazard, and to operate at a relatively high state of tension along their length to retain the occupant within the vehicle. It is required that these conditions are attained early in the inflation process and retained throughout a long duration rollover event. Thus, the short time allowed for the curtain to be positioned in the event of a crash leads to high inertial and pressure loading combined with axial tension which makes high strength yarn that much more important.

The technical requirements for side-curtain airbags underscore the need for high quality yarns with a shrinkage of less than 5% measured in air at 177° C. and with a tenacity equal to or greater than 80 cN/tex with a quality level appropriate for use in airbags or similar fabrics.

In view of the related art disclosures for preparing and realizing high tenacity polyamide yarns and fabrics made from such yarns, and further given the manufacturing inefficiencies encountered in the production of such high tenacity fabrics made from yarns that are not typically characterized by low shrinkage, it would be advantageous and desirable to identify improved procedures for efficiently producing multifilament polyamide yarns having tenacities equal to or greater than 80 CN/tex and hot air shrinkages (according to ASTM D 4974) less than 5%. Such fabrics would be especially desirable for industrial uses including airbags.

SUMMARY OF THE INVENTION

According to the present invention, a multifilament polyamide yarn of less than 940 decitex is provided that exhibits tenacity equal to or greater than 80 cN/tex, and shrinkage of less than 5% as measured at 177° C. The invention is further directed towards fabrics made from such yarns, especially for industrial textiles where fabrics characterized by high strength and dimensional stability are required. The yarns and fabrics which are one object of the present invention are particularly well suited for automotive airbag applications.

In one embodiment the multifilament yarn of this invention is comprised of a plurality of individual polyamide filaments that exhibit linear densities in the range of 1 to 9 decitex per filament (dpf), such that the resulting yarn has a linear density in the range of 110 to 940 decitex.

The yarn of this invention includes melt spinnable polyamides that may be selected from the group consisting of polyamide homopolymers, copolymers, and mixtures thereof which are predominantly aliphatic, i.e., fewer than 85% of the amide-linkages of the polymer are attached to two aromatic rings. Widely-used polyamide polymers such as poly(hexamethylene adipamide), which is nylon 6,6, and poly(ε-caproamide) which is nylon 6, and their copolymers and mixtures can be used in accordance with the invention. In one embodiment the polyamide is nylon 6,6.

According to yet another embodiment of this invention, a woven or knit fabric, e.g., an uncoated woven fabric, or other article of manufacture may be made from the nylon multifilament yarn of this invention, and in one specific embodiment the air permeability of a fabric so produced exhibits a static air permeability less than 100 $l/dm^2/min$ at 500 Pa (measured according to ISO 9237), for example, within the range of 1 to 30 $l/dm^2/min$, or in the range from 1 to 10 $l/dm^2/min$. According to yet another embodiment of this invention, a coated woven fabric or other article of manufacture may be made from the nylon multifilament yarn of this invention, and in one specific embodiment the air permeability of a fabric so produced exhibits a static air permeability in the range 0.01-3.0 $l/dm^2/min$, with suitable coatings comprising a polymer selected from the group consisting of silicones, polyurethanes, and mixtures and reaction products thereof. As used herein, silicones and polyurethanes are meant to include copolymers of each, respectively. Fabrics made according to this aspect of the invention are particularly well suited for automotive airbag applications.

The invention disclosure made in this application also contemplates a composite fabric comprised of a laminated structure comprising a fabric and a film, wherein the film has a density range of 5 to 130 $g/m^2$ and wherein the group from which the film may be selected consists of silicones, polyurethanes and mixtures and reaction products thereof.

In other embodiments, the woven fabrics manufactured from yarns of this invention may be characterized by symmetrical or non-symmetrical woven constructions. Thus, a fabric may be constructed such that these multifilament yarns are woven into both the warp and the weft directions, or such that these yarns are only used in the warp direction or only used in the weft direction. The latter, asymmetrical type of construction may be useful in applications where minimization of fabric shrinkage specifically in the weft direction is desirable.

The invention further includes a spin-draw process for making the multifilament polyamide yarns. This process comprises the steps of: (a) extruding molten nylon at a formic acid relative viscosity from about 40 to about 85 through a multi-capillary spinneret into a plurality of filaments which are then directed through a quench zone; (b) coalescing the filaments into a multifilament yarn and applying lubricating spin finish to the yarn; (c) directing the yarn, by means of at least one feed roll, to a draw zone consisting of at least two pair of driven draw rolls, each roll within a pair rotating at the same peripheral speed, and each pair rotating at a relatively higher peripheral speed than the pair preceding it; (d) causing the yarn to form at least two wraps around each said pair of draw rolls; (e) maintaining the yarn at a temperature of from about 160° to about 245° C. as it passes over the second and optional additional pairs of draw rolls by heating the immediate zone surrounding these pairs of rolls with hot, dry air, or by heating the rolls, or by a combination of both; (f) controlling the relative peripheral speeds of the rolls between each pair of draw rolls and the adjacent pair of draw rolls, and controlling the temperature of the yarn as it passes over the second and optional additional pairs of draw rolls, so as to impart an increasing extent of draw to the yarn as it traverses each pair of draw rolls and finally achieves a total yarn draw ratio of from about 4.2 to about 5.8; (g) directing the yarn to a tension relaxation and control zone consisting of a first driven tension relaxation roll and a second driven tension control roll wherein the first tension relaxation roll is rotating at a lower peripheral speed relative to the final pair of draw rolls from which the yarn just exited, and rotating at a lower rate than the second tension control roll, such that the ratio of peripheral speeds of the second to the first roll in the tension relaxation and control zone is about 1.01 to about 1.07, 1.01 to 1.04, or even 1.02 to 1.034, and so as to maintain a stable yarn tension that is higher than that experienced by the yarn as it exits the draw zone; (h) directing the yarn through an interlacing jet; and (i) directing the yarn to a wind-up roll rotating at a relatively higher peripheral speed than the second roll of the tension relaxation and control zone so as to maintain a stable yarn tension during wind-up, and such that the yarn traversing the tension relaxation and control zone is at a higher tension than the yarn exiting the last pair of draw rolls and at a lower tension than the yarn as it is wound on the wind-up roll.

BRIEF DESCRIPTION OF THE DRAWINGS

The invention can be more fully understood from the following detailed description thereof in connection with accompanying drawings briefly described as follows.

Throughout the following detailed description, similar reference characters refer to similar elements in all figures of the drawings.

DETAILED DESCRIPTION OF THE INVENTION

The present invention is directed toward high strength, low shrinkage polyamide multifilament yarns and fabrics made therefrom, for use in industrial and other demanding applications. The invention is further directed towards a process for manufacturing such yarns.

High strength industrial yarns of the present invention, depending upon the specific end-use application, may be manufactured with linear densities in the range of 110-940 decitex. One example of an end use application for which yarns of this invention are particularly well suited is the manufacture of automotive airbags. High strength yarns of this invention intended for use in the production of airbag fabrics may be manufactured with linear densities ranging from about 235 to about 940 decitex, more typically from about 235-470 decitex, the constituent monofilaments typically 9 dpf or smaller. Any reasonable decitex may be used. Lower denier yarns provide lightness and thinness, but afford less strength and are more expensive to use as more weaving is required to provide the same coverage. When the yarn linear density is smaller than about 235 decitex, the tensile strength and the tear strength of the fabric will typically be insufficient to satisfy airbag specifications. Higher denier yarn (for example greater than about 470 decitex) tends to produce a heavier and thicker fabric which is harder to fold and compromises the compactness of the device. It will be obvious to the skilled observer that for all of the foregoing reasons, higher tenacity yarns represent an advantage.

Polymer suitable for use in the process and yarns of this invention, and which are capable of satisfying the requirements of airbags and other high strength industrial applications, comprise melt spinnable polymers selected from the group consisting of polyamide homopolymers, copolymers, and mixtures thereof which are predominantly aliphatic, i.e., fewer than 85% of the amide-linkages of the polymer are attached to two aromatic rings. Widely used polyamide polymers such as poly(hexamethylene adipamide) which is nylon 6,6 and poly(ε-caproamide) which is nylon 6 and their copolymers and mixtures can be used in accordance with the invention.

While automotive airbags are identified as a particularly appropriate application for the yarns and fabrics of this invention, it should be recognized that the high strength and low shrinkage attributes of these yarns and fabrics made therefrom lend themselves to many other industrial applications including, but not limited to sewing thread, cure wrapping tapes, peel ply fabrics, coated and uncoated fabrics for industrial use, and other applications that require similar attributes.

Figure 1:
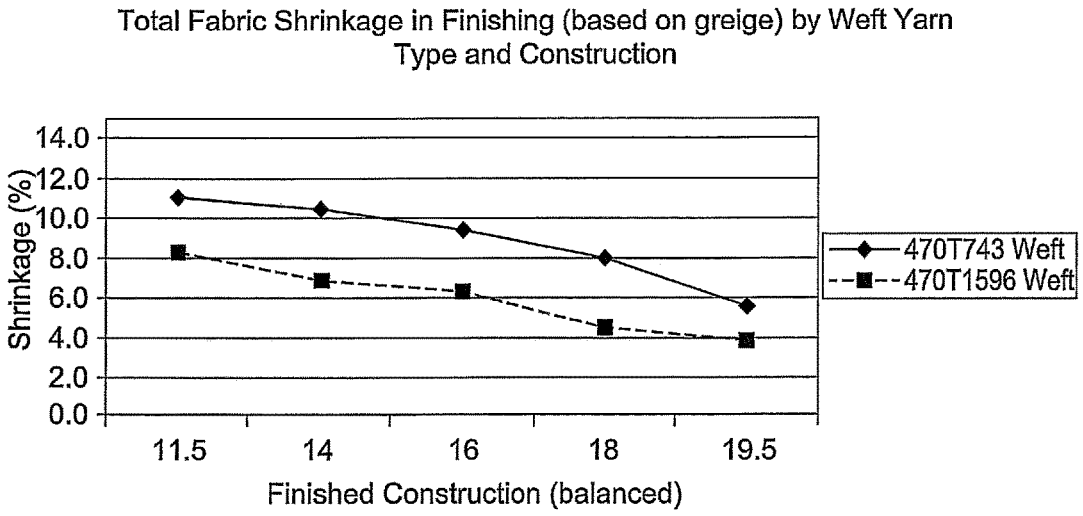
FIG. 1 is a graphical representation of the relationship between fabric shrinkage and the final fabric weave density for two yarns of different tensile strength and shrinkage, each woven over a range of initial weave densities.

The degree of shrinkage that fabrics will display upon heating, treatment in an aqueous bath or a combination of both is a function of the inherent shrinkage of the yarn and the weave density. FIG. 1 illustrates data measured for two yarns. The data show the relationship between fabric shrinkage (as defined by the difference between the fabric dimension parallel to the weft in the "greige" state and the same dimension after scouring and drying) and the final fabric density in terms of the ends/cm measured parallel to the weft direction. The upper curve represents a typical state of the art airbag quality fabric having a tenacity of 84 cN/tex and a hot air shrinkage at 177° C. of 6.6%. The yarn of this fabric is made via a coupled spin-draw process. The individual data points along the curve, representing gradual decreasing fabric shrinkage and increased weave density, are measured on fabrics of increasingly higher initial weave density (i.e. before shrinkage). The lower curve is a similar representation of data for fabric having a tenacity 71 cN/tex and a hot air shrinkage at 177° C. of 2.2%. The yarn of this fabric is made from a decoupled spin and draw, or "two stage" process. As one might expect, fabrics woven to relatively higher weave densities are able to shrink less than relatively more open fabrics. It is also clear from the data that reducing the shrinkage of the yarn has a positive effect on the airbag manufacturer's ability to produce more side curtains, or the same number of wider curtains out of a single fabric blank.

Yarns of the present invention exhibit a minimum tenacity of 80 cN/tex, and hot air shrinkage (measured at 177° C. according to ASTM D 4974) less than 5%, for example in the range of 2.5-4.9%. This combination of attributes is found to be particularly advantageous for airbag applications, and, more particularly, side-curtain protection devices where (1) the inflatable cushion must withstand a higher tension early in the inflation process, and higher and more prolonged tension following deployment, and (2) higher fabric utilization may be achieved due to the lower shrinkage of the fabric blank used in the construction of airbags during post-weaving scouring and drying operations.

Figure 2:
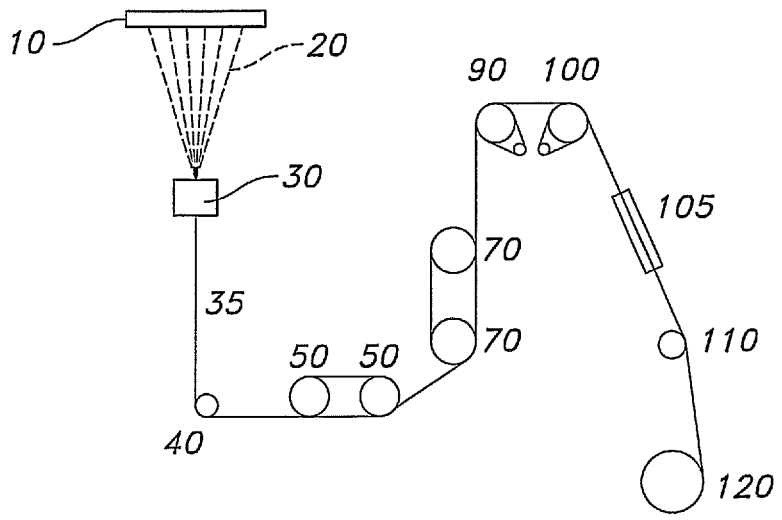
FIG. 2 is schematic illustration of an apparatus for spin-drawing polyamide fiber, wherein the apparatus incorporates a tension relaxation and control zone in accordance with the present invention.

With reference to FIG. 2, a process in accordance with this invention for the manufacture of high strength, low shrinkage polyamide yarns is described. Molten nylon at a formic acid relative viscosity in the range of 40-85 (measured according to ASTM D 789) and prepared by methods well known to those skilled in the art is provided using a conventional extruder (not shown) to a spin filter pack 10 equipped with a multi-capillary spinneret plate. The molten polymer is thereby spun through the capillaries into a plurality of filaments which are cooled in a quench zone 20 and subsequently coalesced at a lubricating spin finish applicator 30, where neat oil finish is applied, into a multifilament yarn 35. The yarn is then directed by at least one feed roll 40 to the first pair of driven draw godet rolls 50. The yarn is wrapped multiple times around the pair of draw rolls 50, each rotating at the same peripheral speed, such that each wrap is laterally displaced along the axis of rotation.

The drawn yarn 35 is then further drawn by advancing it to a pair of driven draw godet rolls 70 around which it is wrapped multiple times, such that each wrap is laterally displaced along the axis of rotation. Both godet rolls 70 rotate at the same speed but are maintained at a relatively higher peripheral speed than rolls 50. The yarn in the draw zone, represented by the region between the godet rolls 70, is heated to 160°-245° C., for example, 205°-215° C. Heating may be accomplished by heating the draw zone with dry, hot air and/or heating the rolls. Similar heating may optionally be provided to the first stage of the draw zone, represented by the region between the godet rolls 50. The drawing of the yarn may be done in any number of stages. Thus, additional sets of rolls may be interposed between at least one feed roll 40 and godet rolls 50, each set of rolls imparting slightly higher degrees of draw until the desired draw ratio is achieved for the yarn that exits the final draw zone represented by the godet rolls 70. Draw ratios of about 4.2 to about 5.8, for example, about 4.7 to about 5.4 are found suitable for producing nylon 6,6 yarn exhibiting a tenacity of 80 cN/tex or greater.

The yarn is forwarded from the draw godet rolls 70 to an unheated tension relaxation and control zone represented by the region between driven rolls 90 and 100. Both of these driven rolls 90 and 100 have associated separator rolls 91 and 92. The threadline wraps around each of these driven rolls and then proceeds to the associated angled separator roll where the threadlines are caused to advance so the threadlines do not overlap the previous wrap on the driven rolls. The yarn friction driving the separator rolls also stabilizes the yarn by providing adequate tension. In one process of this invention, the tension let-down roll 90 of the tension relaxation and control zone rotates at a lower peripheral speed than the draw rolls 70. In this way the high yarn tension maintained in the final draw stage is relaxed as the yarn travels between rolls 70 and 90 and thereby releases shrinkage so that the yarn achieves the desired shrinkage for the particular end use requirement (less than 5%).

The tension control roll 100 and its associated separator roll 92 rotate at higher peripheral speeds than the tension let-down roll 90 and its associated separator roll 91. By controlling the relative peripheral speeds of rolls 90 and 100 in this manner, yarn tension in the tension relaxation and control zone is maintained at a higher level than that of yarn in the final draw stage, thereby ensuring threadline stability. The ratio of peripheral speeds of roll 100 to roll 90 is in the range of about 1.01 to about 1.07, more preferably about 1.01 to about 1.04, most preferably about 1.02 to about 1.034. It is important that the first tension let-down roll 90 have one or less wraps of yarn around it. If additional wraps are placed on the roll, the increased yarn lengthening that will accompany the excess cooling caused by the increased residence time on this roll may result in an unstable threadline which consequently may lead to filamentation, or splaying of the filaments, and threadline breakage.

Subsequent to relaxation and tension control, the yarn is directed through an interlacing air jet 105.

The yarn, after being properly positioned by the change-of-direction roll 110, is then directed to the wind-up roll 120, rotated at a higher peripheral speed than role 100.

In order to achieve shrinkages less than 5% in one embodiment of the invention, it is typically necessary to reduce the tension for yarn exiting the final draw stage (rolls 70) so as to achieve a relaxation ratio of about 9-16.5%. The exact value of the relaxation ratio is dependent upon the temperature of the draw zone. The higher the temperature of the final stage draw zone, the higher the allowable tension, and consequently the higher the relaxation, of the yarn between the final draw stage and the tension let-down roll 90. In one embodiment, a final draw stage temperature of about 210° C. corresponds to a relaxation ratio of about 12 to about 13%. Relaxation ratio is defined by Formula 2:

$$\text{Relaxation Ratio (\%)}=((R_{70}-R_{90})/R_{70})\times 100, \text{ where} \quad [2]$$

$R_{70}$ is the peripheral speed of roll 70, and $R_{90}$ is the peripheral speed of roll 90

This is accomplished by controlling the relative peripheral speeds of the draw rolls 70 and the first tension let-down roll 90. To provide good yarn package formation, the tension on the yarn as it exits roll 90 should be lower than the yarn tension at the wind-up roll 120. This is accomplished by controlling the relative peripheral speeds of the tension control roll 100 and the wind-up roll 120. Thus, the relaxation and tension control zone is configured so as to isolate the relaxation and control tension (between rolls 90 and 100) from the final stage draw (rolls 70) and wind-up zones (roll 120) and maintain yarn tension at a constant level that is higher than that of the yarn in the final stage draw zone (rolls 70) and lower than that of the yarn as it is wound on the wind-up roll 120.

In accordance with the process of this invention, a fully oriented yarn is provided which can satisfy both the tenacity requirement of equal to or greater than 80 cN/tex and the shrinkage requirement of less than 5%.

Various additives may be incorporated within or topically added to the filaments/yarns for the purpose of improving the processability of the yarn spinning and other post-treatment processes, as well as for imparting certain other desirable attributes. Such additives may include, for example, but are not limited to: antioxidants, thermo-stabilizers, smoothing agents, anti-static agents and flame retardants.

Weaving or knitting of the fabrics of this invention from yarns manufactured by a process as just described can be accomplished by entirely conventional means. The formation of woven fabrics from yarns of this invention may be carried out on weaving machines using air-jet, water-jet or mechanical means (such as a projectile or rapier weaving machine) for insertion of weft yarns among a plurality of warp yarns.

As will be appreciated by those of skill in the art, a chemical compound, referred to as a sizing compound, may be applied to the yarns prior to weaving in order to limit the amount of damage from the frictional forces, heat build-up and abrasion caused by the contact of yarns with moving parts and with other yarns during the weaving process. Such sizing compounds can act as a lubricant and/or protective coating so as to maintain the integrity of the yarns. Sizing compounds such as polyacrylic acid, polyvinyl alcohol, polystyrene, polyacetates, starch, gelatine, oil or wax may be used.

The woven fabric of this invention can be subjected to an aqueous treatment that is intended to achieve two purposes: (1) removal of both the spin finish from the fiber spinning process and the sizing compound from the weaving process, and (2) relaxation of any latent shrinkage in the yarn. Removal of processing aids from the yarn is important to avoid any bacterial growth during the long storage times that the fabrics will typically experience before airbag deployment ever becomes necessary, as well as to remove any residual surface material that might be incompatible and interfere with the subsequent, optional application of an air impermeable coating. Relaxation of the latent shrinkage is important to achieving dimensional stability of the fabric and lower gas permeability associated with tightening of the weave structure.

When rapier, projectile or air-jet weaving is employed in the manufacture of fabric of this invention, the aqueous treatment is carried out in an aqueous bath maintained at 60°-100° C., for example, 90°-95° C. The wet treatment time and any bath additives (for example, scouring agents) to be employed depend on the size/spin finish to be removed and may be determined by those skilled in the art. Following the aqueous treatment, the polyamide fabric is dried in hot air at a higher temperature in the range of 140°-160° C., for example, 140°-150° C. in order to achieve a achieve a residual moisture content of 4-6%. It is desirable to maintain the hot air drying temperature at 160° C. or lower to achieve low air permeability. Heating at excessive temperatures or for prolonged times may decrease the moisture content to lower values that may result in re-adsorption of moisture and accompanying destabilization of the woven construction. However, drying at higher temperatures in the range of 170° C.-225° C. may be desired if the fabric is to be coated.

The use of water-jet weaving of polyamide fabrics of the present invention is particularly advantageous since a separate aqueous treatment step for the purpose of removing spin finish and sizing compounds is obviated by the use of water in the weaving loom itself. In fact, the use of sizing compounds can be eliminated entirely when employing water-jet weaving. However, the need for a hot aqueous treatment often still exists because of the requirement to shrink and stabilize the fabric. Such shrinkage can otherwise be effected by the use of hot bars, infrared devices, or other means of radiant heating if the shrinkage is sufficiently low, as it is in the yarns and fabrics of the present invention.

Fabrics according to the present invention which are intended for use in airbag fabrics may exhibit low gas permeability, within the range of 1-30 I/dm$^2$/min, for example, 1-10 dm$^2$/I at 500 Pa. Such permeability values may be achieved using uncoated fabrics as will be recognized by those skilled in the art. If near zero permeability is required, then coating may be needed, as will be recognized by those skilled in the art.

Very dense weaves are one way of achieving low gas permeability. Because of the low shrinkage (less than 5%) of yarns within the scope of this invention, less fabric shrinkage is available to contribute to the final weave density (after aqueous treatment), and, therefore, starting weave constructions must be proportionately higher. Methods of achieving such constructions are known for both mechanical and fluid-jet weaving machines, and any of these methods or similar ones well known in the art that achieve the desired gas permeability levels may be suitably adapted.

Another way of achieving low gas permeability, either with a very dense or relatively less dense woven fabric, is to apply a gas impermeable coating to at least one surface of that fabric at a loading in the range of 5-130 g/m$^2$. Fabrics may be coated using knife, roller, dip, extrusion and other coating methods. Coatings useful for such purposes comprise a polymer selected from the group consisting of silicones, polyurethanes, and mixtures and reaction products thereof.

As used herein, silicones and polyurethanes are meant to include copolymers of each, respectively. This list is not intended to be limiting, and other coatings that perform the same function and do not detract from the required properties or performance parameters of airbag fabrics may be employed.

Still another way of achieving low gas permeability, either with a very dense or relatively less dense woven fabric, is to provide a laminated structure of fabric and film wherein coverage provided by this film is characterized by the range of 5-130 g/m$^2$. Films useful for such purposes comprise a polymer selected from the group consisting of silicones, polyurethanes, and mixtures and reaction products thereof. This list is not intended to be limiting and other films that perform the same function and do not detract from the required properties or performance parameters of airbag fabrics may be employed.

Polyamide yarns used for airbag fabrics are generally made from yarns that exhibit hot air shrinkage (measured at 177° C.) of 5 to 15%. The low permeability that is required for such contact fabrics requires a dense fabric, and these relatively high shrinkage levels help achieve that objective by providing relaxation of the yarn during wet processing.

Woven fabrics of this invention will typically be subjected to a treatment in an aqueous bath at 60° to 100° C., for example 90°-95° C., optionally followed by drying, in order to relax the fabric and make it more dense. This wet treatment also serves to remove any size applied prior to weaving. This is advantageous in order to avoid bacterial infestation during the long storage times that the fabrics typically experience before deployment ever becomes necessary. The aqueous bath also serves to remove any spin finish on the yarn from the fiber spinning process. The aqueous bath treatment is preferably followed by hot air drying at a higher temperature. If low air permeability is desired then the hot air heating process should be maintained at 160° C. or lower. Heating at excessive temperatures can result in re-absorption of moisture with increasing fabric storage time causing destabilization of the woven construction. If coating is required, then higher temperatures may be used, typically in the range of 170° C.-225° C.

The wet treatment time and any bath additives to be employed depend upon the size/finish to be removed and may be determined by those skilled in the art. The wet treatment brings an adequate degree of relaxation, and hence fabric density, for achieving the desired air permeability.

The formation of woven fabrics from yarns of this invention may be carried out on weaving machines using fluid-jet or mechanical means for insertion of weft yarns among a plurality of warp yarns. Entirely conventional weaving equipment, including water-jet, air-jet, projectile or rapier looms may be employed.

As will be appreciated by those of skill in the art, yarns of higher tenacity may require topical application of a chemical compound referred to as sizing compound to enhance the mechanical integrity of the yarns during weaving. Sizing compound that may be used is typically a polyacrylic acid, although other polymers such as polyvinyl alcohol, polystyrene, and polyacetates may likewise be utilized. While the sizing compound is typically effective in enhancing the mechanical integrity of the high tenacity yarns, such sizing tends to enclose yarn oils which may not be compatible with polymeric compounds used for coating the fabric prior to its formation into an airbag structure. Accordingly, it is recommended practice to eliminate the sizing compound, as well as the enclosed yarn oils, by scouring and drying the fabric prior to any coating operation.

It is of particularly useful benefit to provide a fabric which may be used in an airbag or other industrial fabric and which is woven on a water-jet loom. Weaving by this method may lessen or eliminate the preference to apply sizing compound to the yarn. Additionally a separate scouring step is no longer required since the yarn oils applied during spinning are removed during the weaving process itself.

By contrast, the use of rapier or air-jet weaving machines with yarns having no sizing compound thereon may lead to unacceptable yarn damage from the heat build-up and abrasion caused by the contact of the warp ends with moving parts inserted into the warp shed during the weaving process. The use of water-jet weaving avoids yarn damage due to heat build-up and abrasion since the warp yarns are not in contact with moving parts during insertion of fill yarn through the warp shed.

Although water-jet weaving typically results in a lower density weave than rapier weaving, methods such as that disclosed in U.S. Pat. No. 5,421,378 can be employed to water-jet weave a yarn with no applied sizing compound to produce a fabric having a woven density comparable to that achieved with rapier weaving and with no scouring required.

Conventional post-treatments can be used with the fabric of the invention. Specifically, when fabric coatings are used, such as silicone rubber at 20 to 40 grams per square meter, the coatings can modify the static air permeability of the fabrics to achieve near zero air permeability in the range 0.01-3.0 I/dm$^2$/min. Entirely conventional coatings and means to apply the coatings are appropriate for the fabrics of the present invention.

Various additives may be incorporated within or topically added to the filaments/yarns for the purpose of improving the processability of the yarn spinning and other post-treatment processes, as well as for imparting certain other desirable attributes. Such additives may include, for example, but are not limited to: antioxidant, thermo-stabilizer, smoothing agent, anti-static agent and flame retardant. The incorporation of such additives in no way diminishes the advantages of the present invention.

The above embodiments and those described in the Example section below have been presented by way of example only. Many other embodiments of the invention falling within the scope of the accompanying claims will be apparent to the skilled reader.

Test Methods

The following test methods were used in the Examples that follow:

Decitex (ASTM D 1907) is the linear density of a fiber as expressed as the weight in grams of 10 kilometers of yarn, or filament. The decitex (commonly referred to as dtex) is measured by determining the weight of a skein of yarn removed from a package using a wrap wheel.

Yarn breaking force (ASTM D 885) is measured by determining the breaking force of yarn containing 120 turns per meter of twist using a constant-rate-of-extension (CRE) tensile testing machine available from Instron of Canton, Mass. Yarn gauge length is 250 mm and elongation rate is 300 mm/min. The breaking force is reported in units of Newtons.

Yarn tenacity at break and elongation at break are measured according to ASTM D 885. Tenacity at break is the maximum or breaking force of a yarn divided by the decitex, and is usually reported in units of cN/tex.

Fabric break strength is measured in accordance with ISO 13934-1.

Yarn hot air shrinkage is measured in dry heat at 177° C. for a period of 2 minutes according to ASTM D 4974 by subjecting a relaxed yarn to a specified tension load of 0.44 cN/tex, ±0.088 cN/tex The following examples illustrate but do not limit the invention. The particularly advantageous features of the invention may be seen in contrast to the comparative examples, which do not possess the distinguishing characteristics of the invention.

EXAMPLES

All yarns characterized in the following examples were of round cross-section and melt spun from homopolymer nylon 6,6. heat stabilizer additive package was present in the polymer. The yarns were manufactured using a conventional melt spinning process with coupled draw and wind-up stages. The yarns were oiled with a nominal loading of 1% by weight of yarn.

Example 1

Figure 3:
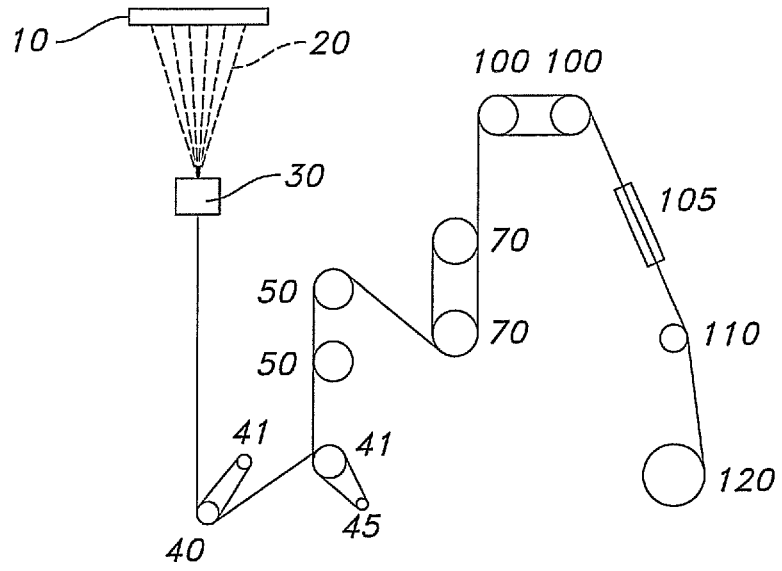
FIG. 3 is a schematic illustration of a prior art apparatus for spin drawing polyamide fiber, wherein the apparatus incorporates a simple tension relaxation zone comprising two tension relaxation rolls running at the same speed.

Sample 1 which exemplifies this invention was made using the spin-draw process with an additional tension relaxation and control step as shown in FIG. 2. The remainder of examples are comparative samples, each identified by a number with a letter prefix, and each is illustrated by FIG. 3. (In FIG. 3, the multifilament yarn 35 is fed to the drawing rolls by a pair of feed rolls, 40 and 45, each with associated separator rolls, 41 and 46.) The comparative samples were each spun and drawn as was Sample 1, except that a tension relaxation step, as illustrated in FIG. 3, was conducted with a coupled pair of relaxation and tension let-down rolls 100, each rotating at the same speed, but lower than that of draw rolls 70. The amount of tension let-down and, therefore, the minimum attainable shrinkage, was determined by observing the minimum tension in this tension relaxation zone that was capable of sustaining a stable threadline.

TABLE 1

| Sample | Decitex | Filament Count | Breaking Force (N) | Tenacity (cN/tex) | Elongation (%) | Shrinkage (%) |
|---|---|---|---|---|---|---|
| 1 | 470 | 140 | 39.5 | 84 | 25 | 4 |
| A-2 | 471 | 68 | 34.2 | 72.6 | 24.5 | 5.6 |
| B-3 | 483 | 136 | 36 | 74.5 | 23.8 | 6 |
| C-4 | 927 | 140 | 72.5 | 78.2 | 22.5 | 6.2 |
| D-5 | 702 | 105 | 58.4 | 83.2 | 23 | 6.4 |
| E-6 | 470 | 68 | 39.5 | 84 | 19.9 | 6.6 |
| F-7 | 480 | 140 | 29 | 60.4 | 21.3 | 6.6 |
| G-8 | 350 | 96 | 25 | 71.4 | 22 | 8.8 |

It is apparent from the data in Table 1 that only Sample 1, the yarn produced in accordance with the present invention, satisfies the desired specifications of tenacity before shrinkage of at least 80 cN/tex and a hot air shrinkage of less than 5%.

Example 2

In this example, summarized in Table 2, woven fabrics are constructed on a water-jet loom using yarns of the present invention or comparative yarns. In all cases the yarns are 470 decitex with a 140 filament count. The yarns of the invention are labelled numerically, and the comparative samples are identified by a number with a letter prefix. The yarns of the present invention are manufactured by the same process as described for the yarn exemplifying the present invention in Example 1. The comparative yarns are manufactured by the same process as described for the comparative yarns in Example 1 with the extent of yarn draw and relaxation varied so as to yield yarns with the varying values of tenacity and shrinkage. All results are obtained on uncoated fabrics.

It is apparent that use of the yarn of the present invention permits relatively low permeability fabrics to be produced with reduced fabric shrinkage compared to previously available high tenacity yarn of comparable tenacity. It is also apparent that higher tenacity fabrics may be produced with lower air permeability compared to previously available low shrinkage yarn.

TABLE 2

| Yarn Sample | Tenacity (cN/tex) | Yarn Shrinkage % | Shrinkage Fabric % | Fabric Break Strength (N) | Air permeability (l/dm$^2$/min) |
|---|---|---|---|---|---|
| 1 | 84 | 4 | 3.2 | 3715 | 5.5 |
| 2 | 84 | 3.5 | 2.8 | 3667 | 5.5 |
| H-3 | 83 | 6.6 | 5.2 | 3655 | 4.0 |
| J-4 | 73 | 8.8 | 6.3 | 3274 | 3.0 |
| K-5 | 72 | 2.2 | 2.0 | 3213 | 8.0 |

Example 3

In this example, summarized in Table 3, woven fabrics are constructed on a One-Piece-Woven (OPW) air-jet loom. The fabrics of the invention are labelled numerically and the comparative fabrics are identified by a number with a letter prefix. The yarns of the present invention and the comparative yarns used to manufacture the fabrics described in Table 3 are manufactured by the same processes as were described in Example 2.

It is apparent that the yarns of this invention may be used to produce very high tenacity airbag cushions (four per loom width) with greater width and comparable strength to fabrics made from previously available high tenacity yarns. Consequently, fabric manufacturing efficiency is maximized.

TABLE 3

| Sample | Tenacity | Yarn Shrinkage % | Cushion Width (cm) | Fabric Break Strength (N) |
|---|---|---|---|---|
| 1 | 84 | 4 | 67.7 | 3357 |
| 2 | 84 | 3.5 | 67.8 | 3315 |
| H-3 | 83 | 6.6 | 66.5 | 3200 |
| K-5 | 72 | 2.2 | 68.3 | 2890 |

What is claimed is:

1. A spin-draw process for manufacturing a multifilament polyamide yarn having a tenacity equal to or greater than 80 cN/tex, a hot air shrinkage at 177° C. of less than 5% measured according to ASTM D4974 and linear density less than 940 decitex comprising the steps:

a. extruding molten nylon at a formic acid relative viscosity from about 40-85 through a multi-capillary spinneret into a plurality of filaments which are then directed through a quench zone;

b. coalescing the filaments into a multifilament yarn and applying lubricating spin finish to said c. directing the yarn, by means of at least one feed roll, to a draw zone consisting of at least two pair of driven draw rolls, each roll within a pair rotating at the same peripheral speed, and each pair rotating at a relatively higher peripheral speed than the pair preceding it;

d. causing the yarn to form at least two wraps around each said pair of draw rolls;

e. maintaining the yarn at a temperature of 160°-245° C. as it passes over the at least two pairs of draw rolls by heating the immediate zone surrounding the said pairs of rolls with hot, dry air or by heating the rolls, or by a combination of both;

f. controlling the relative peripheral speeds of the rolls between each pair of draw rolls and the following pair of draw rolls, and controlling the temperature of the yarn as it passes over the at least two pairs of draw rolls, so as to impart an increasing extent of draw to the yarn as it traverses each pair of draw rolls and finally achieves a total yarn draw ratio of 4.2-5.8;

g. directing the yarn to a tension relaxation and control zone consisting of a first driven tension relaxation roll and a second driven tension control roll wherein said first roll is rotating at a lower peripheral speed relative to the final pair of draw rolls that the yarn just exited, thereby achieving a relaxation ratio of about 12 to about 13%, and rotating at a lower rate than said second roll, such that the ratio of peripheral speeds of the second to the first roll in the tension relaxation and control zone is about 1.01 to about 1.07, and so as to maintain a stable yarn tension in the tension relaxation and control zone that is higher than that experienced by the yarn as it exits the draw zone, wherein the draw zone is at a temperature of 210° C.;

h. directing the yarn through an interlacing jet; and i. directing the yarn to a wind-up roll rotating at a relatively higher peripheral speed than the second roll of the tension relaxation and control zone so as to maintain a stable yarn tension during wind-up, and such that the yarn traversing the tension relaxation and control zone is at a higher tension than the yarn exiting the last pair of draw rolls and at a lower tension than that of the yarn as it is wound on the wind-up roll.

2. A woven or knit fabric comprising a yarn produced in accordance with the process of claim 1.

3. An article of manufacture made from the fabric of claim 2.

4. An uncoated woven fabric of claim 2 characterized by an air permeability of less than 1001/dm$^2$/min at 500 Pa.

5. An uncoated woven fabric according to claim 2 characterized by an air permeability in the range 1 to 30 l/dm$^2$/min.

6. An uncoated woven fabric according to claim 2 characterized by an air permeability in the range of 1 to 10 l/dm$^2$/min.

7. An airbag comprising the fabric of claim 6.

8. A one piece, woven airbag comprising the fabric of claim 6.

9. A fabric according to claim 2 further comprising a coating wherein the coating is applied at a loading in the range of 5 to 130 g/m$^2$ and wherein said coating comprises a polymer selected from the group consisting of silicones, polyurethanes, and mixtures and reaction products thereof.

10. A coated fabric according to claim 9 characterized by an air permeability of less than 2 l/dm$^2$/min.

11. An airbag comprising the fabric of claim 10.

12. A one piece, woven airbag comprising the fabric of claim 10.

13. A fabric according to claim 2 further comprising a laminated structure of fabric and film wherein the film has a density in the range of 5 to 130 g/m$^2$ and wherein said film comprises a polymer selected from the group consisting of silicones, polyurethanes, and mixtures and reaction products thereof.

14. A fabric which comprises a multifilament yarn produced in accordance with the process of claim 1 oriented parallel to the weft direction.

15. A fabric which comprises a multifilament yarn produced in accordance with the process of claim 1 oriented parallel to the warp direction.

* * * * *